US005653428A

United States Patent [19]

Dufour et al.

[11] Patent Number: 5,653,428

[45] Date of Patent: Aug. 5, 1997

[54] PHASE CONTROL SYSTEM FOR A FOLDER FAN

[75] Inventors: Charles Henry Dufour, Durham; Paul Raymond Bolduc, Dover, both of N.H.

[73] Assignees: Heidelberger Druckmaschinen AG, Heidelberg, Germany; Heidelberg Harris, Inc., Dover, N.H.

[21] Appl. No.: 550,430

[22] Filed: Oct. 30, 1995

[51] Int. Cl.[6] ..... B41F 13/58; B31B 1/00

[52] U.S. Cl. ..... 270/6; 270/21.1; 270/42; 270/47; 493/5; 493/14

[58] Field of Search ..... 270/5.01, 6, 5.02, 270/20.1, 21.1, 42, 43, 47; 493/3, 5, 14, 17, 23, 29, 33, 34

[56] References Cited

U.S. PATENT DOCUMENTS

| | | | |
|---|---|---|---|
| 3,362,705 | 1/1968 | Heiel | 493/3 |
| 4,539,002 | 9/1985 | Zak | 493/23 |
| 4,881,731 | 11/1989 | Simpson-Davis . | |
| 5,082,255 | 1/1992 | Brigante et al. | 220/47 X |
| 5,112,033 | 5/1992 | Breton . | |
| 5,123,638 | 6/1992 | Mutunou . | |
| 5,242,364 | 9/1993 | Lehmann | 493/39 X |

*Primary Examiner*—Hoang Nguyen
*Attorney, Agent, or Firm*—Kenyon & Kenyon

[57] ABSTRACT

A phase control system for a fan blade assembly of a folder is provided which includes a fan blade assembly, a folded product transport assembly, and a control system. The fan blade assembly includes a first and second rotating fan blade assembly. The first rotating fan blade assembly has a plurality of first fan blades and has a first circumference. The second rotating fan blade assembly includes a plurality of second fan blades and has a second circumference. A product receiving area is defined at an intersection of the first and second circumferences such that only one of the first and second fan blades can occupy the product receiving area at any instant. The folded product transport assembly is provided for delivering folded products to the product receiving area. The control system includes a first sensor, a second sensor, and a fan blade assembly motor actuator. The first sensor detects an edge each folded product as it passes a first position and outputting a first signal indicative thereof The control system then estimates a first instant at which each folded product will reach a reference position as a function of the output of the first sensor. The reference position is located in the product receiving area. The second sensor detects each first fan blade as it passes a second position and outputs a second signal indicative thereof. The control system then estimates a fan phase angle of the first or second fan blade which will occupy the product receiving area at the first instant as function of the output of the second sensor. The control system can then calculate a phase differential between the fan phase angle and a desired fan phase angle and alter the rotational speed of the fan blade assembly as a function of the phase differential. The rotational speed of the fan blade assembly can be controlled via the fan blade assembly motor actuator.

21 Claims, 14 Drawing Sheets

PHASE CONTROL SYSTEM FOR A FOLDER FAN

FIELD OF THE INVENTION

The present invention relates to a folder apparatus for folding primed products, and more particularly, to a system for monitoring and controlling the phase of fan blades within such a folder apparatus.

BACKGROUND OF THE INVENTION

After a web of paper, which has been fed through a web-fed rotary printing press, is printed, it is fed into a folder apparatus for further processing. In the folder apparatus, the web is generally cut and folded into signatures. The signatures are then separated into a plurality of product streams, and then output for further processing. The separation of signatures into a plurality of product streams can be accomplished by providing a pair of rotating fan assemblies in the signature path.

For example, U.S. Pat. No. 5,112,033 to Breton discloses a folder apparatus including first and second rotating fan assemblies rotating in opposite directions. Cut and folded primed products (e.g., signatures) are transported by high speed conveyor belts into the immediate vicinity of the rotating fan assemblies. Each of the fan assemblies includes a plurality of fan blades, the tips of the fan blades defining the circumference of its respective fan blade assembly. On each of the fan assemblies, adjacent fan blades form pockets for receiving the cut and folded primed products. The circumference of the first fan blade assembly intersects the circumference of the second fan blade assembly and vice versa. To prevent collision between the respective fan blade assemblies, each fan blade has, at its outer radial region, a recess for receiving the tips of the blades of the other fan blade assembly. As each cut and folded printed product exit the high speed conveyor belts, they are alternately received in the pockets formed by adjacent fan blades of one or the other of the fan blade assemblies.

U.S. Pat. No. 5,123,638 purports to disclose a delivery fly arrangement for use with a folder of a printing press, and U.S. Pat. No. 4,881,731 purports to disclose an apparatus for feeding sheets, particularly bank notes.

SUMMARY OF THE INVENTION

When feeding products into a fan blade assembly, it is important to regulate the release of the product from a folded product transport assembly (e.g., high speed conveyor belts) with the phase of the fan blades to insure that the products are received and transported by the fan blades undamaged. In accordance with the present invention, a phase control system for a fan blade assembly of a folder is provided.

The fan blade assembly includes a first rotating fan blade assembly having a plurality of first fan blades. The tips of the respective first fan blades define a first circumference of the first rotating fan blade assembly. A second rotating fan blade assembly includes a plurality of second fan blades. The tips of the respective second fan blades define a second circumference of the second rotating fan blade assembly. At an intersection of the first and second circumferences is a product receiving area. The product receiving area is defined such that only one of the first and second fan blades can occupy the product receiving area at any given time. The folded product transport assembly is provided for delivering folded products to the product receiving area. The folded product transport assembly may include, for example, a pair of high speed belts and/or a cutting cylinder assembly.

The phase control system includes a processing unit, a first sensor, a second sensor, and a fan blade assembly motor actuator. The first sensor detects an edge of each folded product as it passes a first position, and outputs a first signal indicative thereof. In accordance with a preferred embodiment of the present invention, the first position is defined as the point at which a blade of the cutting cylinder assembly cuts the folded product. Alternatively, the first position can be defined at any point along the high speed belts, in the product receiving area, or at any other suitable location in the folder. Based upon the output of the first sensor and the web speed of the printing press, the control system, through the processing unit, estimates a first instant at which each folded product will reach a reference position, the reference position being located in the product receiving area.

The second sensor detects each first fan blade as it passes a second position and outputs a second signal indicative thereof. Based upon the output of the second sensor, the control system, through the processing unit, estimates a fan phase angle of the first or second fan blade occupying the product receiving area at the first instant. Then, the control system calculates a phase differential between the fan phase angle and a desired fan phase angle. A display device may be provided for displaying the phase angle or phase differential to an operator.

The fan blade assembly motor actuator controls a rotational speed of the fan blade assembly. The control system, by issuing control signals from the processing unit to the fan blade assembly motor actuator, alters the rotational speed of the fan blade assembly as a function of the phase differential. By repeatedly altering the rotational speed of the fan blade assembly in this manner, the control system matches the fan phase angle to the desired fan phase angle.

As set forth in more detail below, a variety of factors can be used to set the desired phase angle. For example, if the products (e.g. folded signatures) are released from the high speed belts too early in the fan blade rotation, then the trailing end of the product may become wrapped around the fan blade, thereby jamming the fan blade assembly. In contrast, if the products are released too late in the fan blade rotation, then the products will have insufficient time to slow down, and will "crash" into the back ends of the pockets between fan blades, thereby damaging the products. The rate at which the products slow down after being released from the belts will be a function of the inertia of the products and the friction between the products and the fan blades. Another problem which arises is print damage caused by excessive friction between the signature and the fan blade. Based upon the above, a desired fan phase can be experimentally determined which avoids the problem of jamming, crash, and print damage.

In accordance with a further embodiment of the present invention, the desired fan phase is varied as a function of application and environmental variables. As discussed in more detail below, the friction between the products and the fan blades is a function of various other factors such as the weight and width of the paper used, the amount of silicone in the paper, and the amount of tack in the press run. Moreover, the inertia of the products will also be a function of the web speed of the press, and the weight of the paper used. Finally, the amount of friction which will cause print damage to the product will vary with the temperature and humidity. Consequently, it is advantageous to adjust the desired phase angle based upon the values of one or more of these environmental and application variables. The variables can either be manually input from a console, or be automatically measured with sensors. The desired phase angles corresponding to the various combinations of variables can, for example, be empirically determined and stored in memory as an N×N matrix, where N is the number of variables. The appropriate desired phase angle could then be readily read out of the matrix by inputting the current values of the variables.

In accordance with a still further embodiment of the present invention, the control system can be programmed to mimic the procedures followed by human operators. For example, the manner in which an operator manually adjusts the fan phase in response to a range of various conditions such as web speed, temperature, paper type, or any other environmental or application variable can be monitored by the control system and automatically stored in a table in memory. Then, during subsequent press operation, the desired phase angle could be read from the table based upon current environmental and application variables.

BRIEF DESCRIPTION OF THE DRAWINGS

FIG. 3(*b*) shows the fan assemblies of FIGS. 1 & 2 in position 1.

FIG. 3(*c*) shows the fan assemblies of FIGS. 1 & 2 in position 2.

FIG. 3(*d*) shows the fan assemblies of FIGS. 1 & 2 in position 3.

FIG. 3(*e*) shows the fan assemblies of FIGS. 1 & 2 in position 4.

FIG. 3(*f*) shows the fan assemblies of FIGS. 1 & 2 in position 5.

FIG. 3(*g*) shows the fan assemblies of FIGS. 1 & 2 in position 6.

FIG. 3(*h*) shows the fan assemblies of FIGS. 1 & 2 in position 0'.

FIG. 7(*b*) illustrates a phase angle of a fan blade.

DETAILED DESCRIPTION OF THE INVENTION

Figure 1:
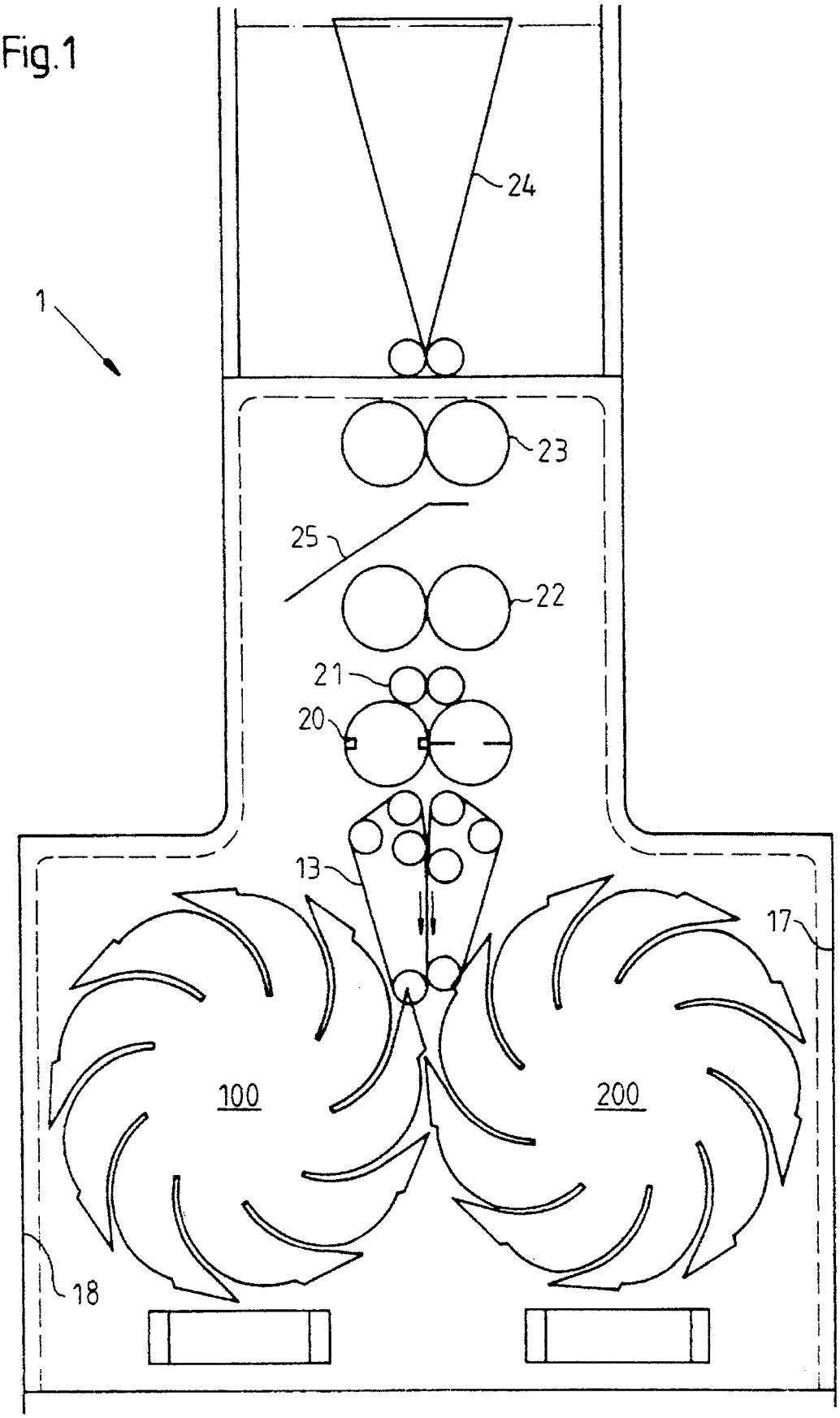
FIG. 1 shows a folder having a pair of fan assemblies.

FIG. 1 shows an illustrative folder 1 for cutting and folding printed products. A web of paper is folded in a former 24, and is then cut into signatures by a cutting cylinder assembly 20. The signatures are then transported by a pair of high speed belts 13 towards a pair of fan blade assemblies 100, 200. In the illustrated system, the fan blade assemblies 100, 200 rotate in opposite directions, and are synchronized with each other so that they do not collide.

Figure 2:
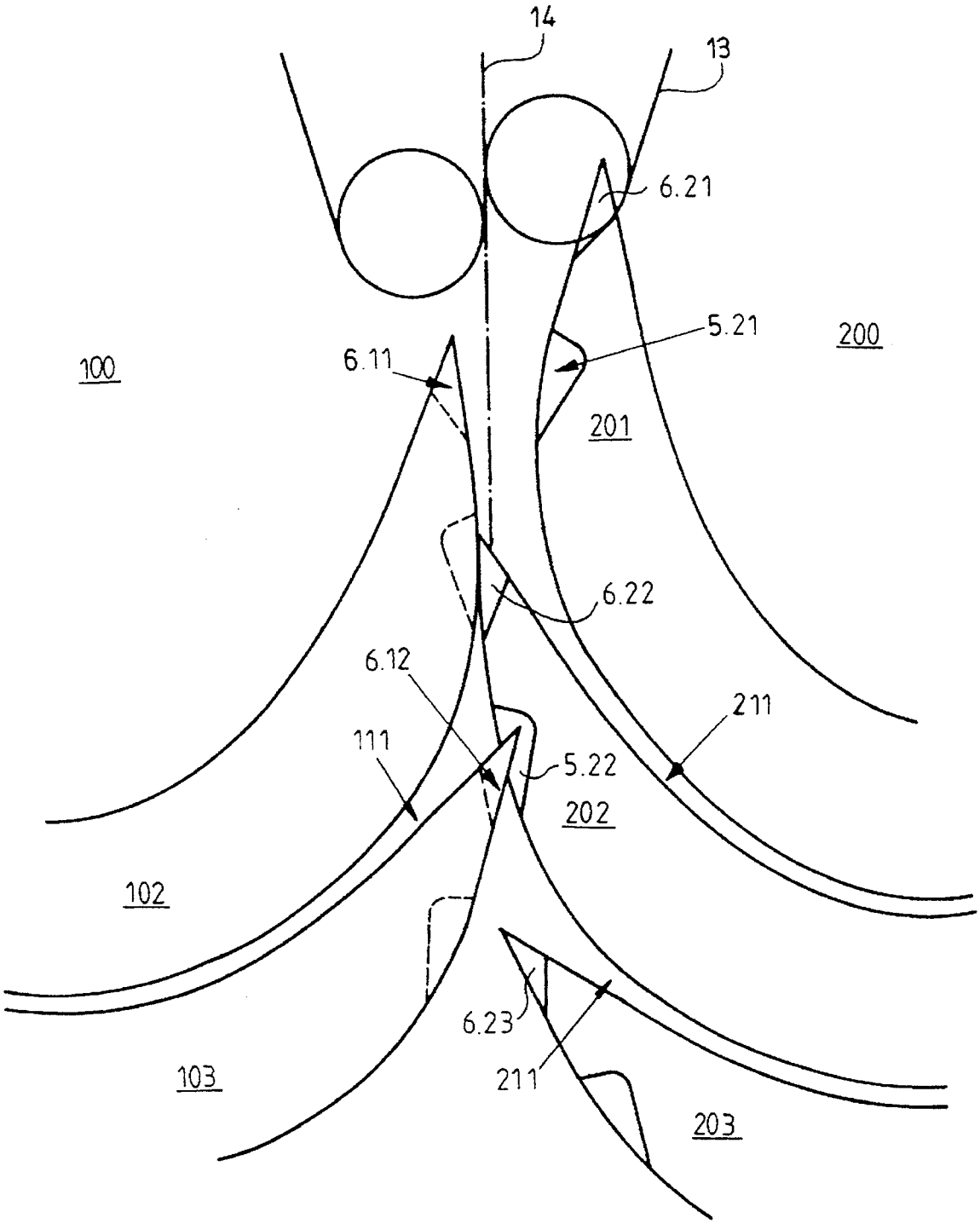
FIG. 2 shows the fan assemblies of FIG. 1 in greater detail.
Figure 3A:
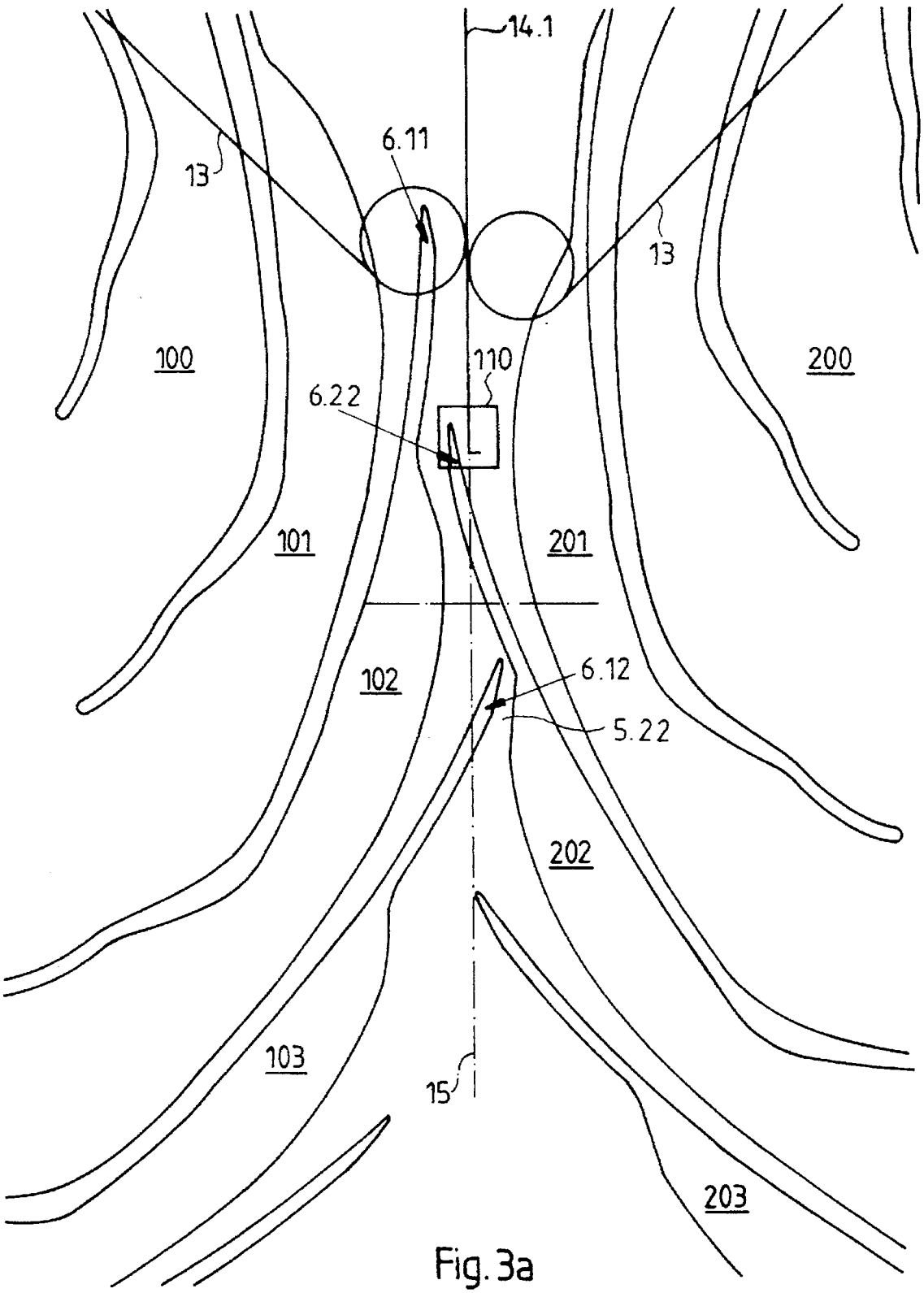
FIG. 3(*a*) shows the fan assemblies of FIGS. 1 & 2 in position 0.
Figure 3B:
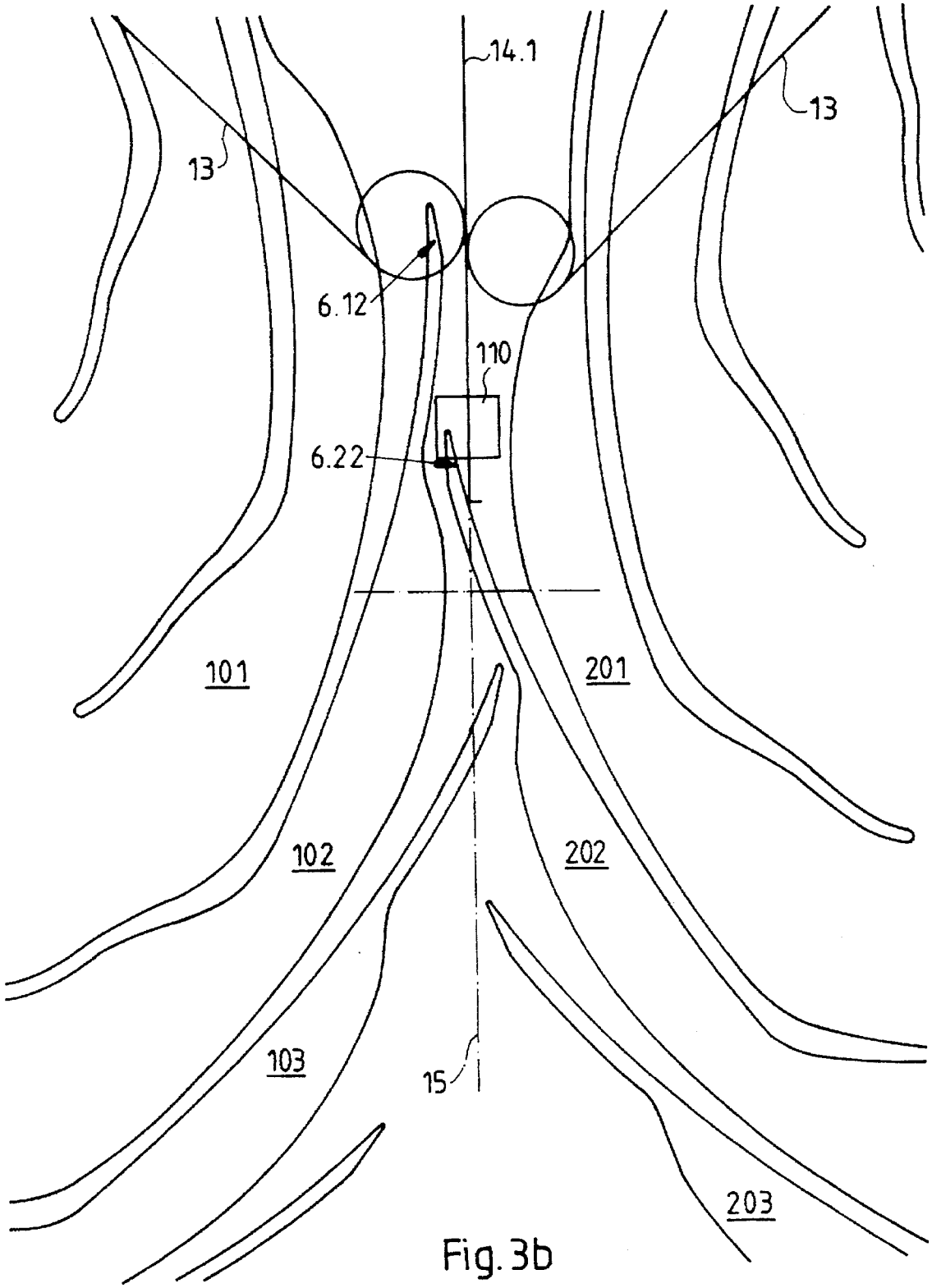
Figure 3C:
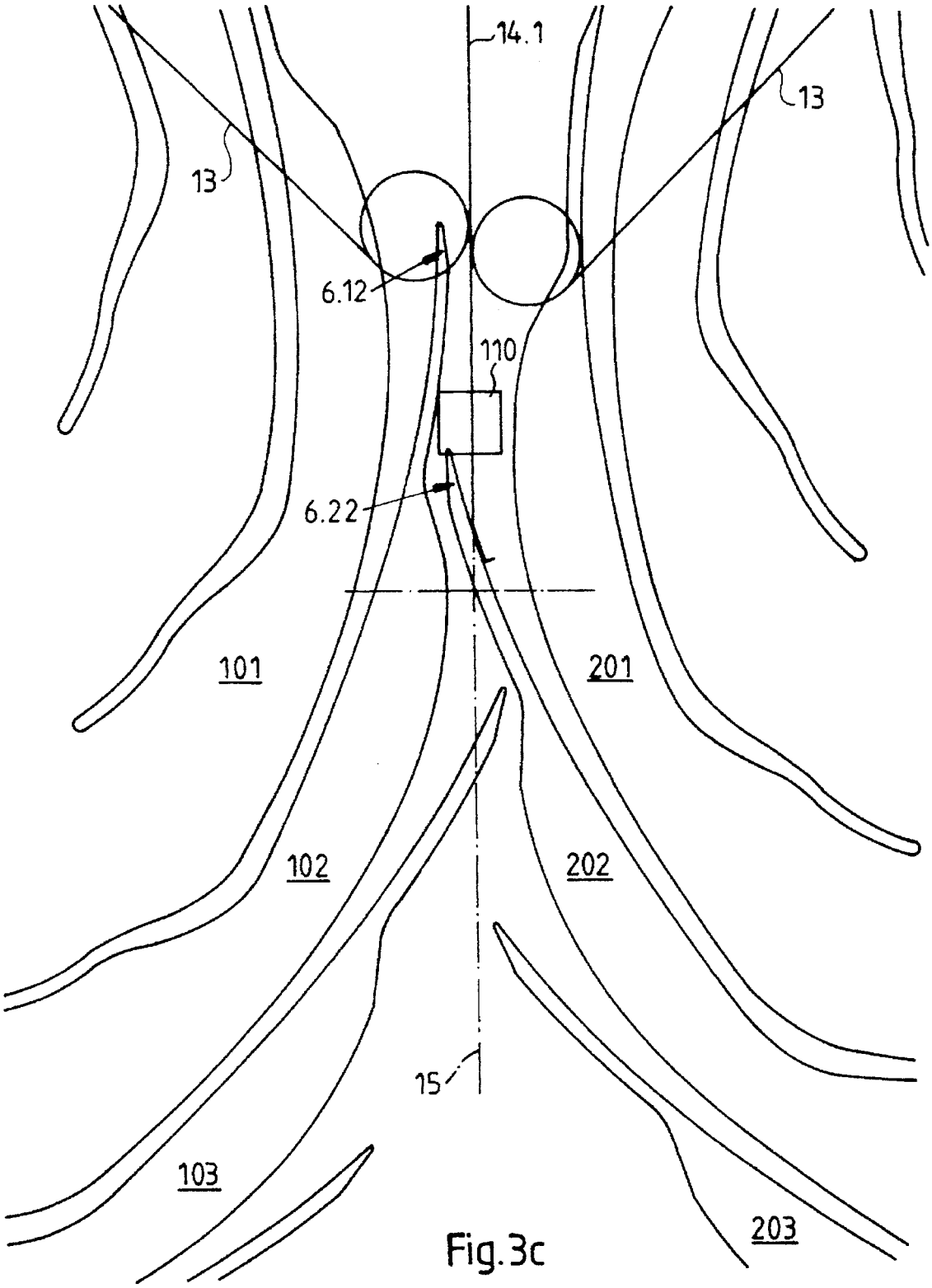
Figure 3D:
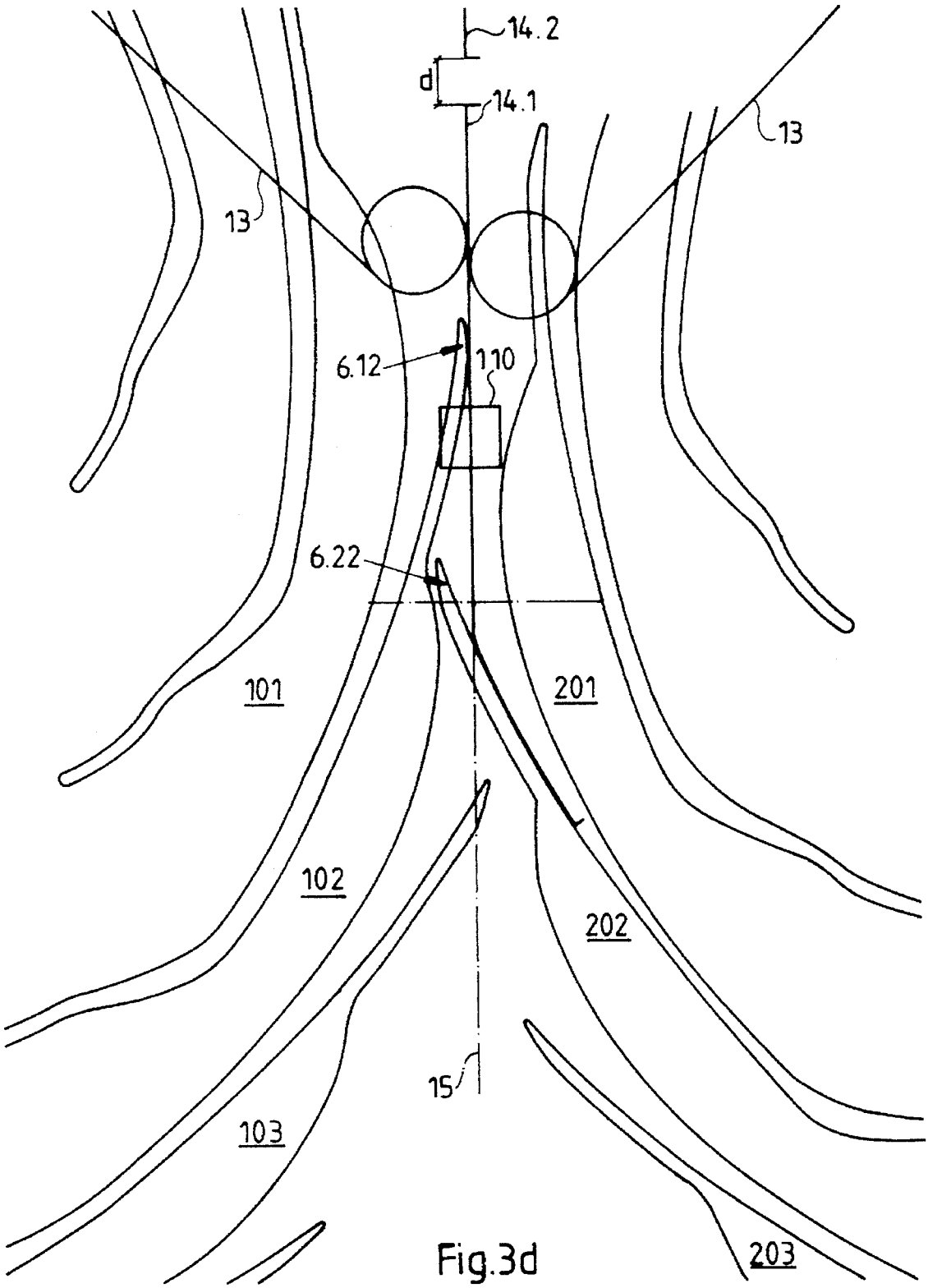
Figure 3E:
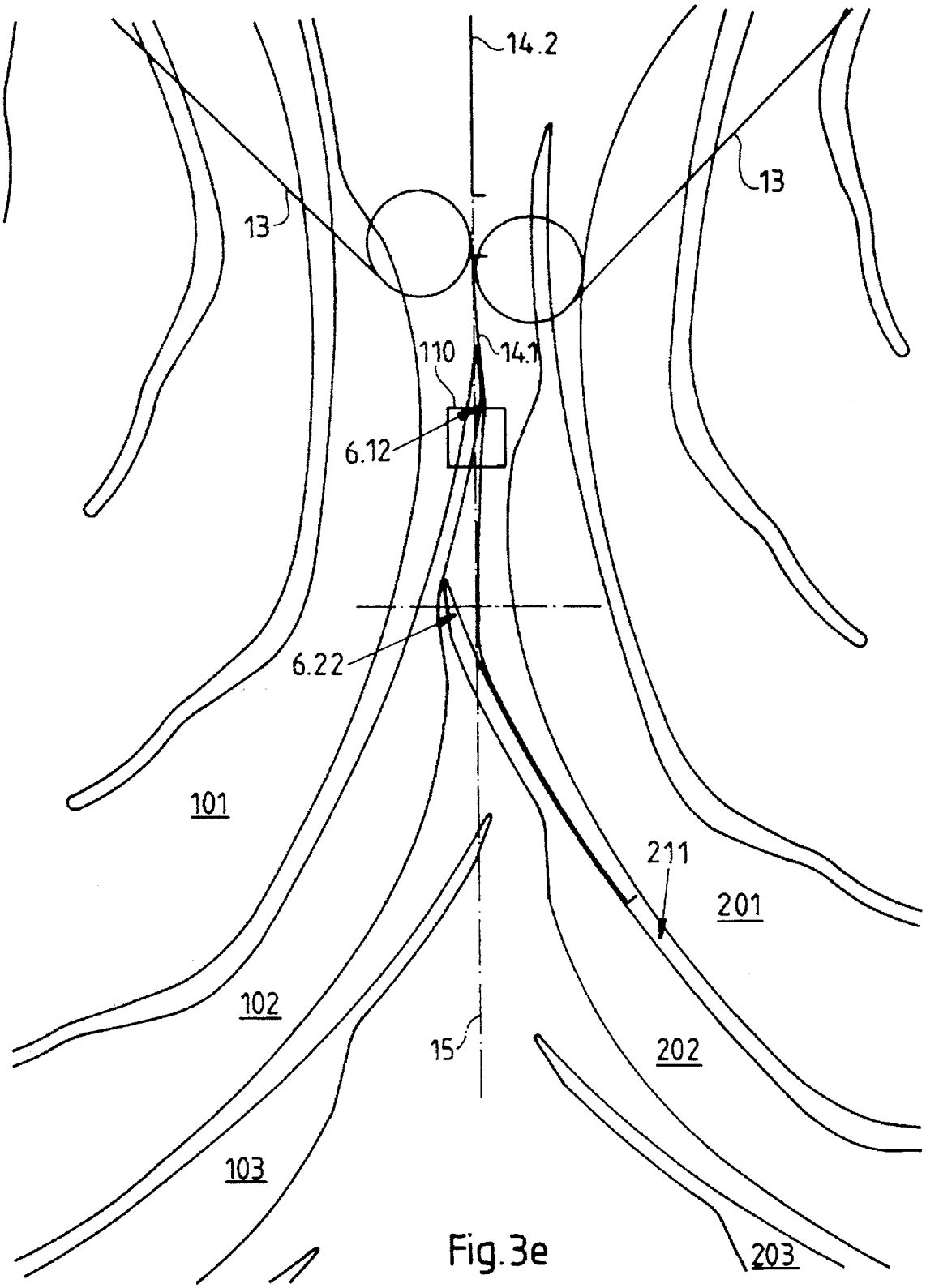
Figure 3F:
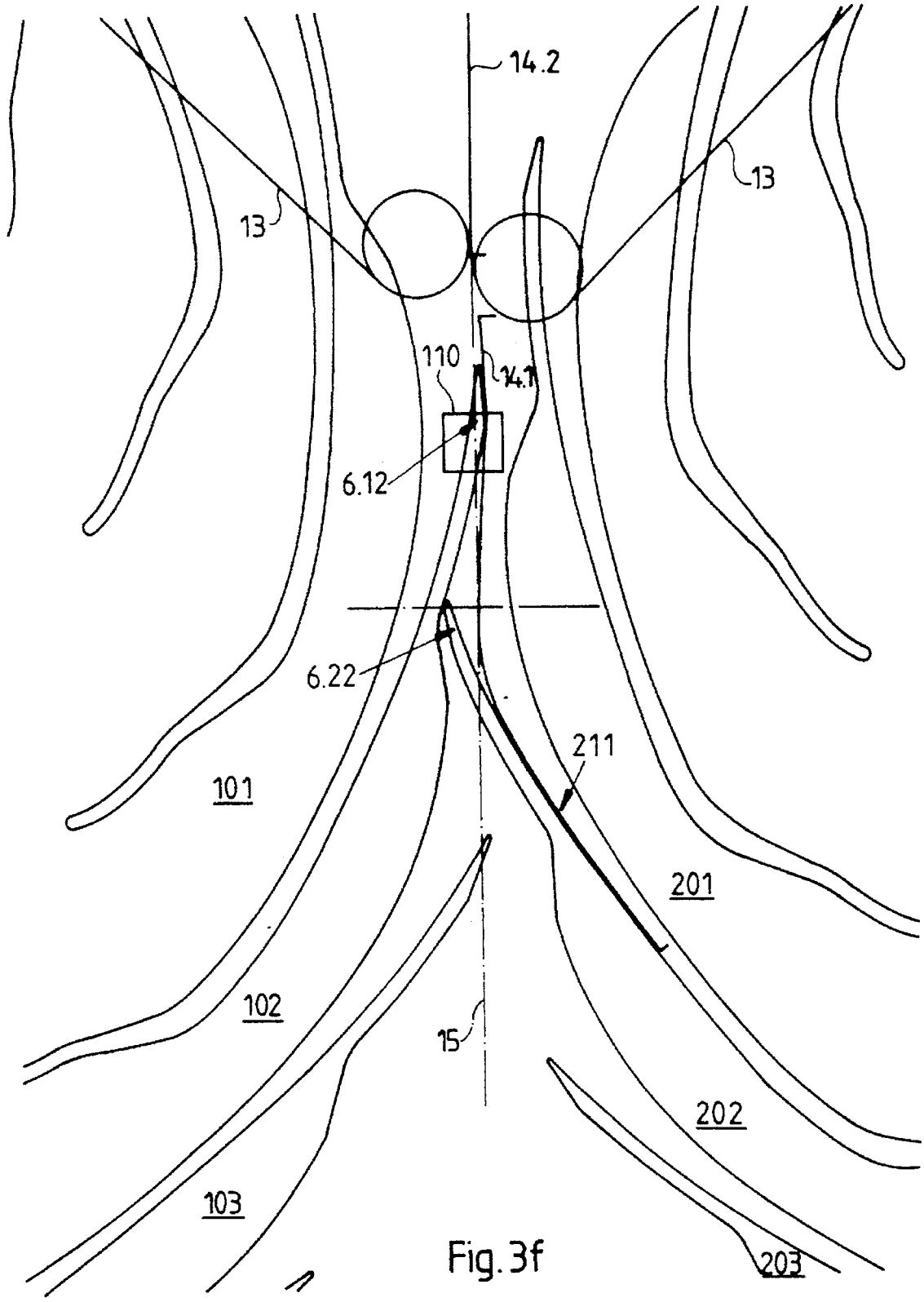
Figure 3G:
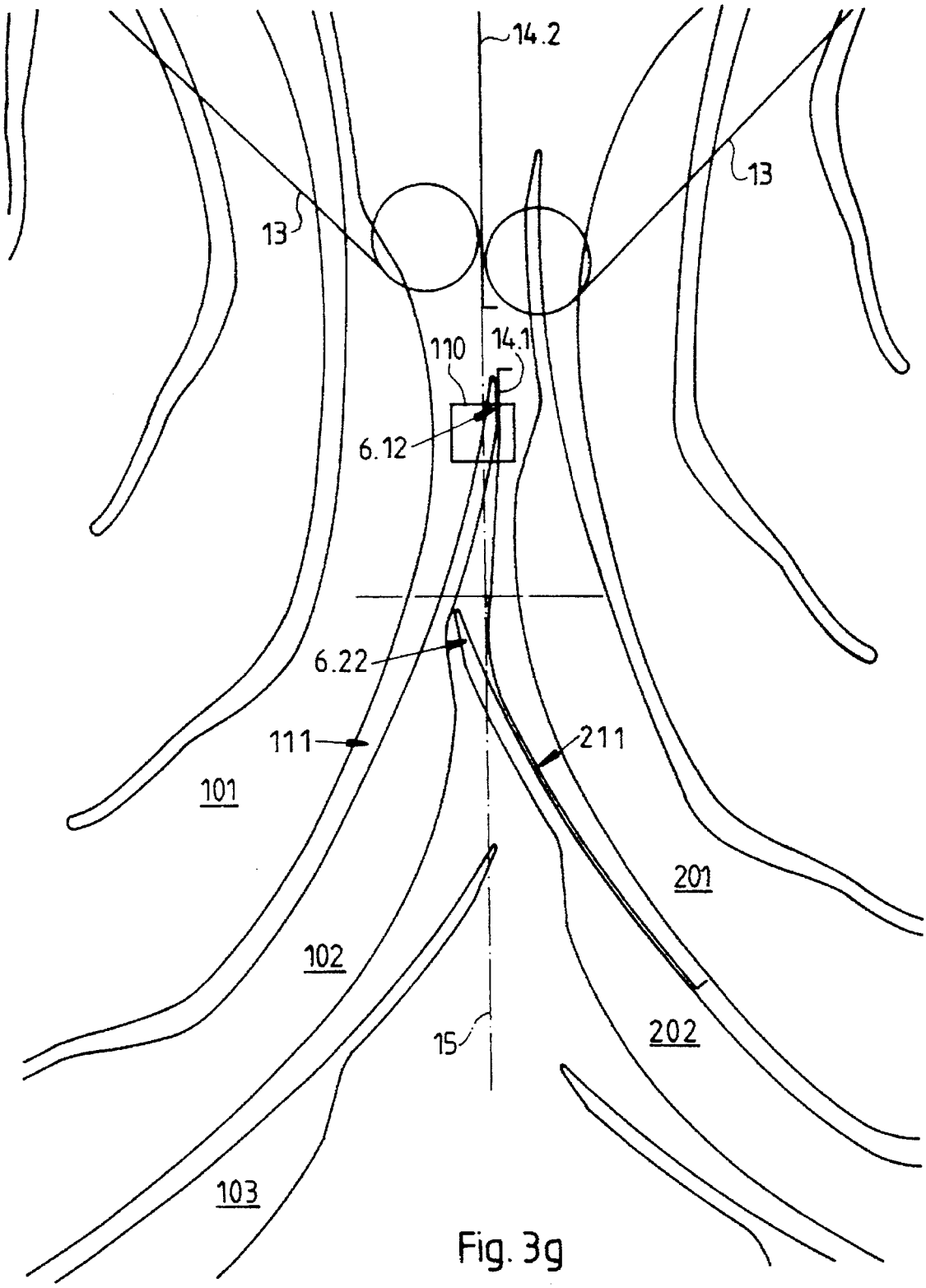
Figure 3H:
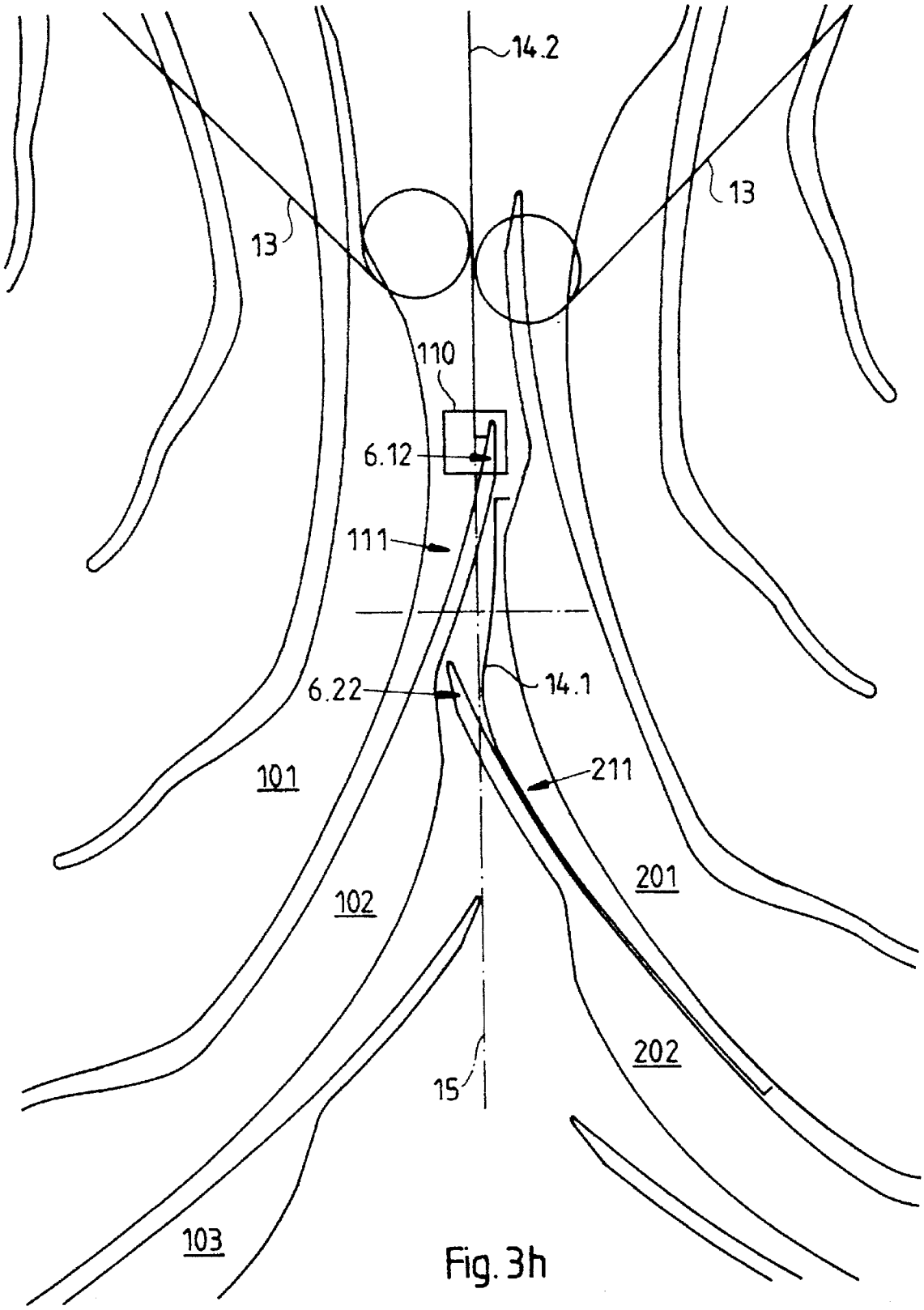

FIG. 2 shows the fan blade assemblies 100, 200 in greater detail. Signatures exiting the high speed belts 13 are received in the pockets 111, 211 formed by adjacent fan blades (102, 103)(201, 202)(202, 203) of respective fan blade assemblies 100, 200. Referring to FIG. 2, a signature 14 is shown exiting high speed belts 13 and entering the pocket 211 formed by adjacent fan blades 201, 202. Each fan blade includes a fan blade tip 6 and fan blade recess 5 which cooperate so as to prevent a collision between fan blades. As an illustration, fan blade recess 5.22 is shown receiving the corresponding fan blade tip 6.12.

The functioning of the fan blade assemblies 100, 200 will now be described with reference to FIGS. 3(*a–h*), which illustrates the position of the fan blade assemblies 100, 200 at eight discrete instants. Referring to FIG. 3(*a*), a signature 14.1 is shown in "zero position", i.e. at a point just prior to impact with the tip 6.22 of fan blade 202 of fan blade assembly 200. As illustrated, a portion of the signature 14.1 remains engaged with the high speed belts 13 at this time, and as the signature 14.1 exits the belts 13 it travels along a centerline 15 at a conveying speed W. At this position, tip 6.22 of fan blade 202 extends past the centerline 15 to receive the signature 14.1, tip 6.13 of fan blade 103 is received in the recess 5.22 of fan blade 202, and the tip 6.12 of fan blade 102 is well clear of the centerline 15.

FIG. 3 (*b*) shows the signature 14.1 at position 1, the point at which the signature 14.1 first contacts the tip 6.22 of fan blade 202. The tip 6.12 of fan blade 102 is still well clear of the centerline 15, and a portion of the signature 14.1 remains engaged by the high speed belts 13. Since the signature 14.1 is still engaged by the high speed belts, it continues to travel at conveying speed W (approximately) despite the friction resulting from the contact with the tip 6.22. Referring to FIG. 3(*c*), the signature 14.1 will bend slightly as it slides along the surface of the fan blade 202, but will continue to travel at the conveying speed W because of its continued engagement with the high speed belts 13. At this position (position 2), the tip 6.12 of fan blade 102 is approaching, but has not yet intersected, the centerline 15.

FIG. 3(*d*) shows the fan blade assemblies 100, 200 in position 3. In this position, the signature 14.1 continues to travel at the conveying speed W under the control of the high speed belts 13. However, the tip 6.12 of fan blade 102 has now intersected the centerline 15, and is in contact with the signature 14.1. In addition, a second signature 14.2 is shown traveling in the high speed belts 13, the second signature 14.2 trailing the signature 14.1 by a distance d, and traveling at the conveying speed W.

FIGS. 3(*e,f,g*) show the signature 14.1 leaving the high speed belts 13. Once the signature 14.1 has left the high speed belts 13, the friction resulting from contact with the fan blade 202 will cause the signature 14.1 to slow down as it travels towards the back of the pocket 211. At the same time, the tip 6.12 of the fan blade 102 pushes the signature 14.1 off of the centerline 15.

In FIG. 3(*h*), the fan blade assemblies 100, 200 are shown in position 0'. In this position, the signature 14.1 has cleared fan blade 102, and is continuing to travel along the fan blade 202 towards the back of the pocket 211 formed by adjacent fan blades 201, 202. In addition, the second signature 14.2 is shown approaching the tip 6.12 of fan blade 102. As described with respect to signature 14.1 in FIGS. 3(*a–g*), the second signature 14.2 will contact the tip 6.12 of fan blade 102, and travel towards the back of the pocket 111 formed by adjacent fan blades 101, 102.

In order to insure that the signatures 14 are properly received in the pockets 111 and 211 undamaged, it is important to properly set the phase between the signatures 14 and the fan blade assemblies 100, 200 (hereinafter "the fan phase"). A number of factors may be considered in setting the fan phase.

Specifically, if the signatures 14 are released from the belts 13 too early in the fan blade rotation, then the trailing end of the signature may become wrapped around the fan blade (e.g. 202), resulting in jamming of the fan blade assemblies 100, 200. In contrast, if the signatures 14 are released from the belts 13 too late in the fan blade rotation, then the signatures 14 will have insufficient time to slow down, and will "crash" into the back ends of the pockets 111 and 211, thereby damaging the signatures. The rate at which the signatures slow down after being released from the belts 13 will be a function of the inertia of the signatures and the friction between the signatures and the fan blades.

Another problem which arises is print damage caused by excessive friction between the signature and the fan blade. The earlier the signatures 14 are released in the fan blade rotation, the longer the signature remains in friction with the fan blade. This friction between the signature and the fan blade causes the ink on the signature to be marked. Consequently, the earlier the signatures 14 are released, the greater the friction, and, therefore, the greater the print damage to the signature 14.

Additional factors, which vary with environmental conditions and the particular print job, also affect the desired fan phase. For example, the humidity in the press room may affect the degree to which the ink will dry before exiting the high speed belts 13. This, in turn, may affect the print damage resulting from a given fan phase. Similarly, product type, paper type, tack, and silicone may also affect the desired fan phase. For example, the frictional and inertial characteristics of an 8 page signature will be different from a 24 or 32 page signature. The composition and thickness of the paper used will also affect these characteristics. Tack, which is defined as the amount of static electricity in the signatures, is a variable which is conventionally set by a "Tacker". In addition, the amount of silicone added to the web can also be varied in conventional printing presses. The values chosen for tack and silicone will also affect the frictional and inertial characteristics of the signatures as they enter the fan pockets 111 and 211.

In prior art systems, the phase of the rollers 13 with respect to the fan blade assemblies 100, 200 was set manually by observing the position of signatures entering the fan blade assemblies with a strobe (or with the naked eye) and then adjusting the speed of the high speed belts 13 accordingly. This method of setting fan phase has several disadvantages. First, manually setting the speed of the belts 13 based upon strobes is inherently inaccurate, and therefore, it is impossible to optimize the phase setting in this manner. An additional problem arises from the fact that the speed of the folder must be able to vary with the web speed of the printing press, and the web speed of the printing press can vary greatly, e.g. from 0 to 3000 fpm. As set forth above, signature "crash" results from the signature having insufficient time and/or space to slow down after release from the high speed belts 13. The time and/or space necessary to slow down the signature, in turn, is function of the speed of the belts 13, and the speed of the belts 13 is a function of the web speed of the press. Therefore, the incremental change in belt speed necessary to advance or retard the fan phase, will change as the web speed of the press changes. This change cannot adequately be addressed by manual adjustment of the phase during a press run. As a result, in prior art systems, the phase of the fan blades relative to the conveyor belts was set during a press run to a nominal value which provided acceptable, but by no means optimal, results at all operating speeds.

Figure 4:
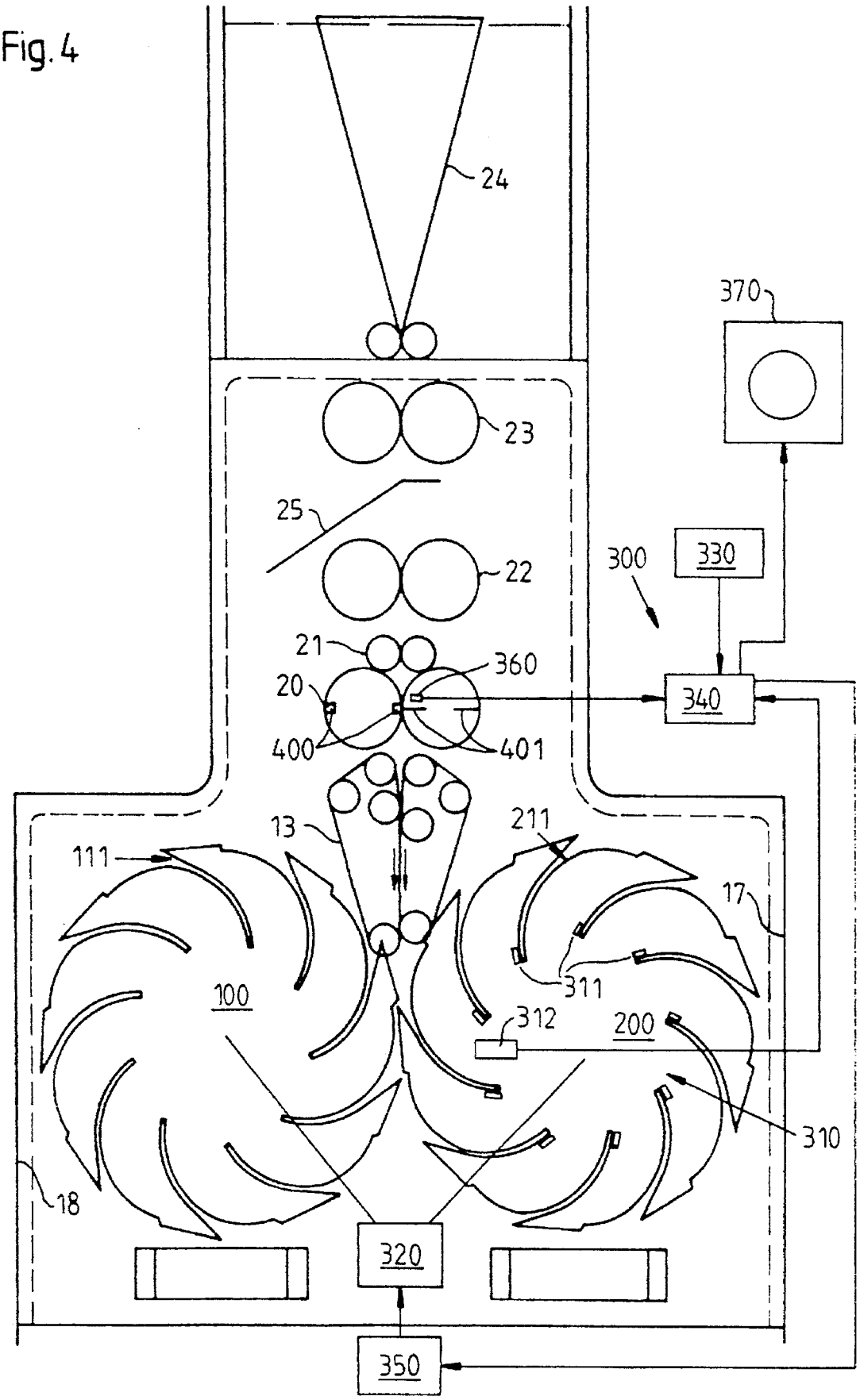
FIG. 4 shows an illustrative phase control system for the fan assemblies of FIGS. 1–3 in accordance with the present invention.

The above-referenced problems are solved in accordance with the fan phase control system according to the present invention. FIG. 4 shows an illustrative fan phase control system in accordance with the present invention. A fan phase control system 300 includes a fan blade position sensor 310, a fan assembly motor 320, a web speed detector 330, a signature position sensor 360, a processing unit 340 and a fan assembly motor controller 350.

The fan blade position sensor 310 may include, for example, respective targets 311 mounted adjacent to each of the respective pockets 111, 211 on one of the fan assemblies 100, 200, and a target sensor 312 suitably mounted for detecting the targets 311. The targets 311 can, for example be metal tabs mounted on the fan blades next to the pockets 111 and 211. The target sensor 312 could, for example, be a proximity switch which senses the metal tabs.

The signature position sensor 360 is used to determine the position of the signature 14. The signature position sensor 360 can be implemented in a variety of ways. For example, a sensor could be mounted relative to the cutting cylinder assembly 20 of the folder 1. The cutting cylinder assembly 20 cuts the folded web into signatures 14. Therefore, a sensor on the cutting cylinder 20 can definitively determine the instant at which the cutting cylinder forms a signature. Since the distance between the cutting cylinder and the high speed belts 13 is known, and since the speed at which the signature travels upon exiting the cutting cylinder must be substantially equal to the web speed of the press (known from the sensor 330) the instant at which a leading or trailing edge of a signature exits the belts 13 is determinable. Alteratively, the speed of the signature exiting the cutting cylinder be measurable from the rotational speed of the cylinders 20.

As an example, the signature position sensor 360 could be formed by mounting a target next to each blade 401 of the cutting cylinders 20, and placing a sensor adjacent to the position at which the blade 401 contacts the pocket 400 of the cutting cylinders 20. At a time to when the sensor is triggered, the position of the leading and trailing edges of signature 14 is known. In addition, the speed at which the signature 14 will travel from the cutting cylinders through the high speed belts 13 can be estimated as equal to the web speed of the press, since any significant deviation from the web speed would cause a paper jam. Alternatively, the speed at which the signature 14 travels can be calculated more directly by monitoring the rotational speed of the cutting cylinders 20 and of the rollers driving the high speed belts. In either case, the time $t_1$ at which the leading edge of the signature 14 reaches the "zero position" shown in FIGS. 3(*a*, *h*), can be defined as: $t_1=D/W+t_0$, where D is the distance between the "zero position" and the position at which the blade 401 contacts the pocket 400, and W is the web speed of the press. Similarly, the position of a leading edge of a signature 14 at any time t, can be defined as a distance $D(t)=W(t-t_0)$ from the position at which the blade 401 contacts the pocket 400. Naturally, the position of the trailing edge of the signature 14 could be defined in a similar manner. Alternatively, a sensor (e.g., an optical sensor) could be mounted adjacent to the zero position. A period between leading edges of the signatures could be derived from the trigger signals emitted by the sensor and then, the instant $t_1$ could be estimated as the time of the last trigger plus the period.

An illustrative method for determining the fan blade position will now be discussed with reference to the fan blade position sensor 310 including targets 311 and the target sensor 312. As the fan blade assemblies 100, 200 rotate, the targets 311 trigger the target sensor 312. Since the shape of the fan blades is known, the position of the fan blade tip at the instant the sensor 312 is triggered (or any other portion of the fan blade associated with the target 311 which triggered the target sensor), is readily determinable. Moreover, the position of the fan blades at any time between trigger signals can be readily extrapolated from any set of two or more trigger signals. Consequently, the position of the fan blade tip in a product receiving area 110 at $t_1$ can be readily determined. As illustrated in FIGS. 3(*a–h*), since only one fan blade tip occupies the product receiving area 110 at any given time, the signatures 14 will be delivered, alternately, to pockets 111, 211 of fan blade assemblies 100 and 200.

Figure 5:
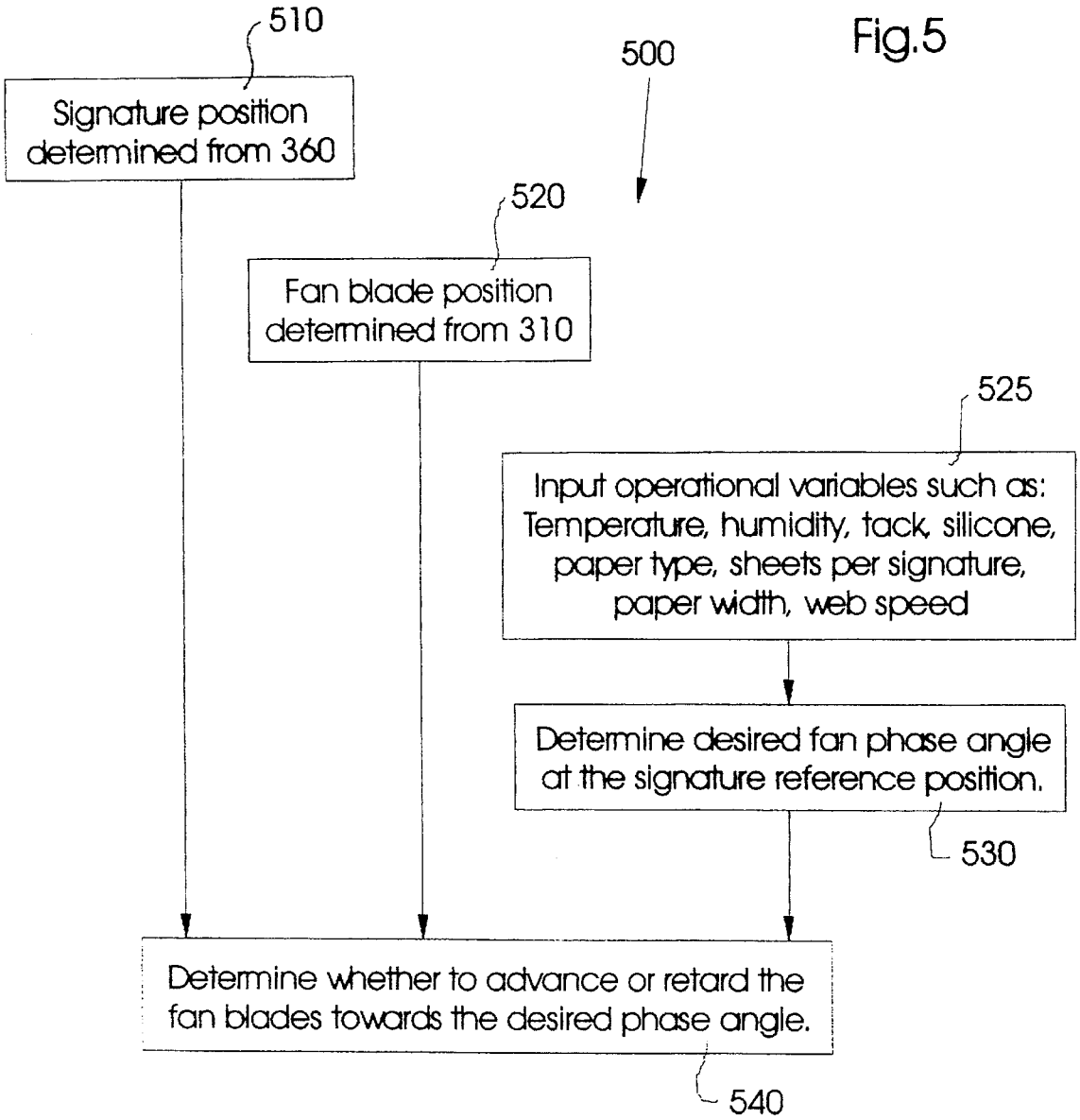
FIG. 5 shows an illustrative flow chart for controlling the phase control system of FIG. 4.

FIG. 5 shows a high level flow chart 500 for the phase control system of the present invention. In steps 510 and 520, the signature position and fan blade position are determined. The signature and fan blade positions can, for example, be calculated in the control unit 340 based upon information received from the sensors 310, 330, and 360 as described above. In addition, one or more environmental and application variables are evaluated in step 530 in order to determine a desired phase angle of the fan blades relative to a signature reference position (e.g., the zero position). As set forth above, the behavior of the signature 14 as, it enters the fan blade pockets 111, 211 will vary with the weight of the paper used, the tack, the temperature, the humidity, the amount of silicone in the paper, and the number of sheets per signature. Consequently, it is advantageous to adjust the desired phase angle based upon the values of these operational variables. The variables can either be manually input from a console, or be automatically measured with sensors. The desired phase angles corresponding to the various combinations of variables can, for example, be empirically determined and stored in memory as an N×N matrix, where N is the number of variables. The appropriate desired phase angle could then be readily read out of the matrix by inputting the current values of the variables. Once the fan blade position, signature position, and desired phase angle are known, the processing unit 340 determines, in block 540, whether to advance or retard the phase angle of the fan blades towards the desired phase angle. If a change in phase angle is necessary, a signal is sent to the fan assembly motor controller 350 to effect the desired phase change.

Figure 6:
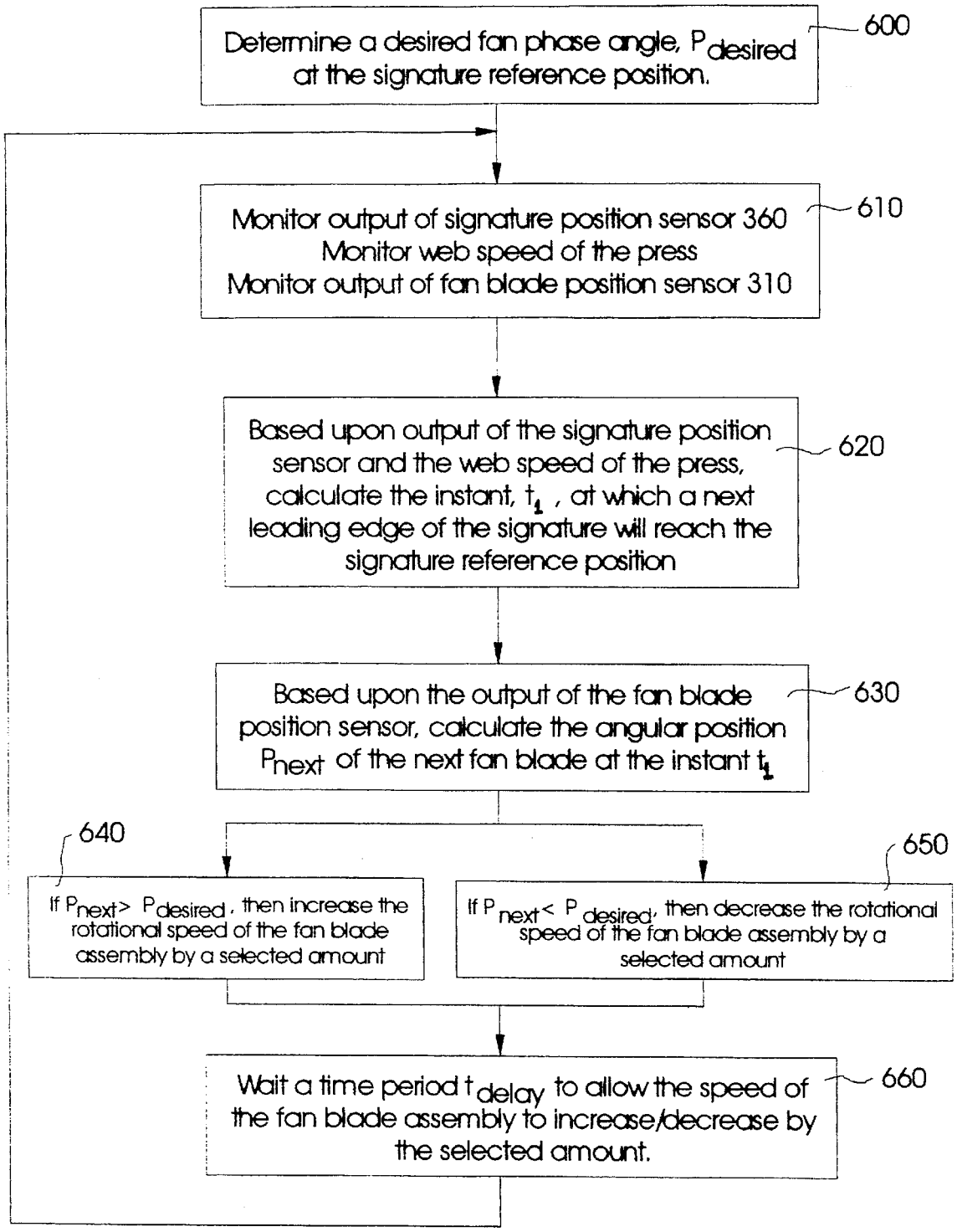
FIG. 6 shows a more detailed flow chart for controlling the phase control system of FIG. 4.

FIG. 6 shows a more detailed flow chart for controlling the fan phase in accordance with a further embodiment of the present invention. At step 600, the controller 340 determines a desired fan phase angle, $P_{desired}$, at a signature reference position; i.e., the desired fan phase angle for a fan blade in the product receiving area at the instant a signature reaches the signature reference position. In accordance with a preferred embodiment of the present invention, the signature reference position is defined as the zero position. As discussed above, the desired fan phase angle can be determined as a function of various environmental and application variables. At step 610, the controller 340 monitors the output of the signature position sensor 360, the web speed detector 330, and the fan blade position sensor 310.

At step 620, the controller 340 calculates the instant $t_1$, at which the leading edge of the next signature 14 will reach the signature reference position. As discussed above, this instant can be determined as a function of the output of the signature position sensor 360 and the web speed of the press (W) since the distance (D), from the cutting cylinder assembly 20 to the zero position is known, and the instant ($t_0$) at which the signature is formed at the cutting cylinder assembly 20 is detected by the signature position sensor. At step 630, the phase angle $P_{next}$ of the next fan blade at the instant $t_1$ is determined. As discussed above, the phase angle of the fan blades at any instant can be determined from the output of the fan blade position sensor.

Figure 7A:
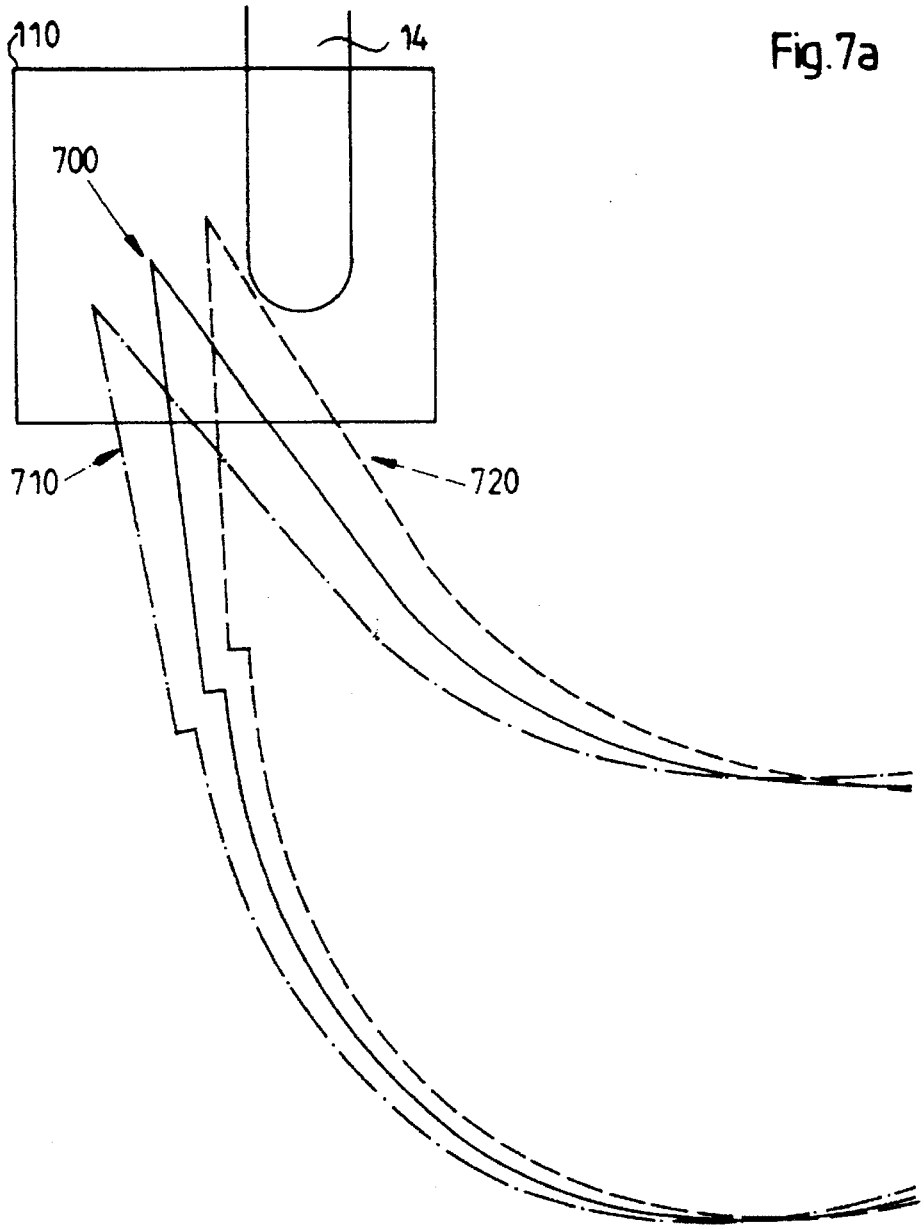
FIG. 7(*a*) shows various phase angles relative to a desired phase angle of a fan blade.
Figure 7B:
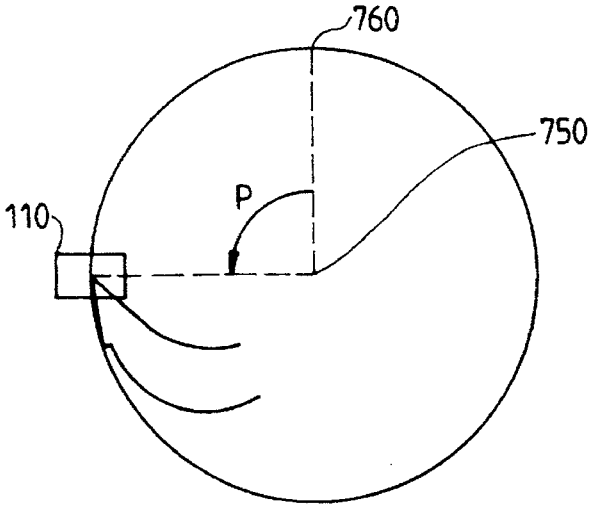

Referring to FIG. 7(*b*) the phase angle P is defined as the angular position of the fan blade tip in the product receiving area 110 relative to a reference plane extending perpendicularly through the rotational axis of the fan blade assembly. In FIG. 7(*b*), the reference plane is defined as a vertical plane 760 extending upwards from the axis 750. At step 640, if $P_{next}<P_{desired}$, then the controller 340 sends an instruction to the fan assembly motor controller 350 to increase the rotational speed of the fan blade assembly. Alternatively, if in step 650 $P_{next}>P_{desired}$, then the controller 340 sends an instruction to the fan assembly motor controller 350 to decrease the rotational speed of the fan blade assembly. The mount by which the rotational speed is incremented or decremented can be determined in a variety of ways. For example, the rotational speed could be incremented or decremented by a fixed deviation, regardless of the difference between $P_{next}$ and $P_{desired}$. The value of the fixed deviation could be determined empirically. Alternatively, the mount by which the rotational speed is incremented or decremented could vary depending upon difference between $P_{next}$ and $P_{desired}$. Alternatively, the value could be determined as a function of an algorithm, or be read it from a table as a function of the phase deviation. Referring to FIG. 7(*a*), if blade position 720 corresponds to $P_{next}$ and blade position 700 corresponds to $P_{desired}$, then $P_{next}<P_{desired}$, and the controller 340 will increase the rotational speed of the fan blade assembly 100, 200. In contrast, if blade position 710 corresponds to $P_{next}$ and blade position 700 corresponds to $P_{desired}$, then $P_{next}>P_{desired}$, and the controller 340 will decrease the rotational speed of the fan blade assembly 100, 200.

In accordance with a further embodiment of the phase control system according to the present invention, the controller 340 can be programmed to mimic the procedures followed by human operators. For example, the manner in which an operator manually adjusts the fan phase ($P_{desired}$) in response to various conditions such as web speed, temperature, paper type, or any other operational variable can be monitored by the controller 340 and automatically stored in a table in memory. Then, during subsequent press operation, the desired phase angle $P_{desired}$ would be read from the table based upon current environmental and application variables. The above-steps can be implemented, for example, as step 530 in the flow chart of FIG. 5, or as step 600 in the flow chart of FIG. 6.

In accordance with another embodiment of the present invention, a fan phase display system is provided. In accordance With the fan phase display system in accordance with the present invention, a display device 370 is coupled to the controller 340 described above. The controller 340 determines the fan blade phase as described above with reference to FIGS. 5 and 6, and then transmits the fan blade phase to the display device 370 for display. In addition, the controller 340 and display device 370 could be programmed to display other useful information, such as: the absolute phase position relative to the reference position, the current deviation from the desired phase angle. In addition, the controller 340 could be programmed to display a historical sample of the phase position over time. The historical sample could also be displayed graphically so that the operator could observe trends in the phase deviation. The fan phase control system can be implemented separately from, or in conjunction with, the phase control system described above.

In addition, it should be clear that while the preferred embodiments of the present invention described herein utilize fan blade assemblies with overlapping fan blade circumferences, the present invention is equally applicable to other types of fan blade assemblies including, for example, fan blade assemblies having non-overlapping fan blade circumferences, and a diverter mechanism.

What is claimed is:

1. A phase control system for a fan blade assembly of folder, comprising:

a first sensor for detecting a position of a folded product, the first sensor outputting a signal indicative of the position of the folded product;

a second sensor for detecting a fan blade as it passes a predetermined angular position, the second sensor outputting a second signal indication of the predetermined angular position;

a controller coupled to the first and second sensor, the controller for coupling to the fan blade assembly, the controller controlling a phase of the fan blade assembly as a function of the first and second signals.

2. A fan phase display system, comprising:

a fan blade assembly including a first rotating fan blade assembly having a plurality of first fan blades and having a first circumference, and a second rotating fan blade assembly having a plurality of second fan blades and having a second circumference, a product receiving area defined at an intersection of the first and second circumferences such that only one of the first and second fan blades can occupy the product receiving area at any instant;

a control system having a processing unit and a display device, and further including:

a first sensor for detecting an edge each folded product as it passes a first position and outputting a first signal indicative thereof, the processing unit estimating a first instant at which each folded product will reach a reference position as a function of the first signal, the reference position being located in the product receiving area, a second sensor for detecting each first fan blade as it passes a second position and outputting a second signal indicative thereof, the processing unit estimating, as function of the second signal, a fan phase angle of the first or second fan blade which will occupy the product receiving area at the first instant, the processor unit transmitting the estimated fan phase angle to the display device.

3. The fan phase display system according to claim 2 wherein the processor unit calculates a phase differential between the fan phase angle and a desired fan phase angle, and transmits the estimated phase differential to the display device.

4. A phase control system for a fan blade assembly of a folder, comprising:

a fan blade assembly including a first rotating fan blade assembly having a plurality of first fan blades and having a first circumference, and a second rotating fan blade assembly having a plurality of second fan blades and having a second circumference, a product receiving area defined at an intersection of the first and second circumferences such that only one of the first and second fan blades can occupy the product receiving area at any instant;

a folded product transport assembly for delivering folded products to the product receiving area;

a control system having a processing unit and including a first sensor for detecting an edge of each folded product as it passes a first position and outputting a first signal indicative thereof, the processing unit estimating a first instant at which each folded product will reach a reference position as a function of the first signal, the reference position being located in the product receiving area, a second sensor for detecting each first fan blade as it passes a second position and outputting a second signal indicative thereof, the processing unit estimating, as function of the second signal, a fan phase angle of the first or second fan blade which will occupy the product receiving area at the first instant; the processing unit calculating a phase differential between the fan phase angle and a desired fan phase angle;

a fan blade assembly motor actuator for controlling a rotational speed of the fan blade assembly, the processing unit causing the fan blade assembly motor actuator to alter the rotational speed of the fan blade assembly as a function of the phase differential.

5. The phase control system according to claim 4, wherein the control system further includes:

a third sensor, the third sensor monitoring one or more operational variables of the printing press, and outputting a third signal indicative thereof, the processor setting the desired phase angle as a function of the third signal.

6. The phase control system according to claim 5, wherein the one or more operational variables includes a web speed of the printing press.

7. The phase control system according to claim 6, wherein the one or more operational variables further includes one or more of a weight of the folded product, and a width of the folded product.

8. The phase control system according to claim 6, wherein the one or more operational variables further includes one or more of an amount of silicone applied to the folded product, and an amount of tack applied to the folded product.

9. The phase control system according to claim 6, wherein the one or more operational variables further includes one or more of temperature and humidity.

10. The phase control system according to claim 5, wherein the control system further includes a display device, the processor unit transmitting one or more of the estimated fan phase angle, and the estimated phase differential to the display device.

11. A method for controlling a phase of a fan blade assembly of a folder of a printing press, the fan blade assembly having a plurality of fan blades, the fan blade assembly having a product receiving region, the fan blades receiving folded products in the product receiving region, the method comprising the steps of:

(a) detecting an edge of a folded product as it reaches a first reference position;

(b) detecting the fan blades as they pass a second reference position;

(c) determining a desired fan phase angle for a next fan blade entering the product receiving region;

(d) estimating a first instant at which a next folded product will reach the first reference position based upon the detection in step (a);

(e) estimating an actual fan phase angle of the next fan blade at the first instant as a function of the detection in step (b); and (f) controlling a rotational speed of the fan blade assembly based upon a difference between the actual fan phase angle and the desired fan phase angle.

12. A method for controlling a phase of a fan blade assembly of a folder of a printing press, the fan blade assembly having a plurality of fan blades, the fan blade assembly having a product receiving region, the fan blades receiving folded products in the product receiving region, the method comprising the steps of:

(a) detecting an edge of a folded product as it reaches a predetermined position relative to a first reference position;

(b) detecting the fan blades as they pass a second reference position;

(c) determining a desired fan phase angle for a next fan blade entering the product receiving region;

(d) estimating a first instant at which the folded product will reach the first reference position based upon the detection in step (a);

(e) estimating an actual fan phase angle of the next fan blade at the first instant as a function of the detection in step (b); and (f) controlling a rotational speed of the fan blade assembly based upon a difference between the actual fan phase angle and the desired fan phase angle.

13. The method according to claim 12, wherein step (b) further includes:

monitoring a transport speed of the folded product; and determining the desired fan phase angle as a function of the transport speed of the folded product.

14. The method according to claim 13, wherein the step of monitoring the transport speed of the folded product, further includes monitoring a web speed of the printing press.

15. The method according to claim 12, wherein step (b) further includes:

monitoring one or more operational variables of the printing press; and determining the desired fan phase angle as a function of the one or more operational variables of the printing press.

16. The method according to claim 15, wherein the step of monitoring one or more operational variables further includes monitoring a weight of the folded product.

17. The method according to claim 15, wherein the step of monitoring one or more operational variables further includes monitoring a width of the folded product.

18. The method according to claim 15, wherein the step of monitoring one or more operational variables further includes monitoring humidity.

19. The method according to claim 15, wherein the step of monitoring one or more operational variables further includes monitoring temperature.

20. The method according to claim 15, wherein the step of monitoring one or more operational variables further includes monitoring an amount of silicone applied to the folded product.

21. The method according to claim 15, wherein the step of monitoring one or more operational variables further includes monitoring an amount of tack applied to the folded product.

* * * * *